US011767136B1

(12) United States Patent
Bison

(10) Patent No.: US 11,767,136 B1
(45) Date of Patent: Sep. 26, 2023

(54) SHIPPING PALLET WRAPPING SYSTEM

(71) Applicant: Darrel Bison, Phoenix, AZ (US)

(72) Inventor: Darrel Bison, Phoenix, AZ (US)

( * ) Notice: Subject to any disclaimer, the term of this patent is extended or adjusted under 35 U.S.C. 154(b) by 0 days.

(21) Appl. No.: 17/902,785

(22) Filed: Sep. 2, 2022

Related U.S. Application Data

(63) Continuation of application No. 17/222,843, filed on Apr. 5, 2021, now Pat. No. 11,434,029.

(60) Provisional application No. 63/004,651, filed on Apr. 3, 2020.

(51) Int. Cl.
*B65B 11/02* (2006.01)

(52) U.S. Cl.
CPC ..... *B65B 11/025* (2013.01); *B65B 2210/20* (2013.01)

(58) Field of Classification Search
USPC ..... 53/399
See application file for complete search history.

(56) References Cited

U.S. PATENT DOCUMENTS

| | | | |
|---|---|---|---|
| 1,109,461 | A | 9/1914 | Price |
| 1,351,809 | A | 9/1920 | Sutherland |
| 2,026,282 | A | 12/1935 | Leguillon |
| 2,823,530 | A | 2/1958 | Rikard |
| 3,019,573 | A | 2/1962 | Navikas |
| 3,793,798 | A | 2/1974 | Lancaster |
| 3,896,604 | A | 7/1975 | Marantz |
| 4,102,513 | A | 7/1978 | Guard |
| 4,166,589 | A | 9/1979 | Hoover |
| 4,172,608 | A | 10/1979 | Brown, Jr. |
| 4,235,062 | A | 11/1980 | Lancaster, III |
| 4,255,918 | A | 3/1981 | Lancaster |
| 4,353,515 | A | 10/1982 | Weaver |
| 4,369,614 | A | 1/1983 | Tetzner |

(Continued)

FOREIGN PATENT DOCUMENTS

| | | |
|---|---|---|
| DE | 3933952 C1 | 5/1990 |
| DE | 19505240 | 3/1996 |

(Continued)

OTHER PUBLICATIONS

JPO machine translation of JP 10-129609 A, Aug. 14, 2013 4 pages.

(Continued)

*Primary Examiner* — Chinyere J Rushing-Tucker
(74) *Attorney, Agent, or Firm* — BOOTH UDALL FULLER, PLC; Kenneth C. Booth

(57) ABSTRACT

A pallet wrapping system with a support bar and at least two adjustment arms coupled to the support bar. The at least two adjustment arms are configured to narrow the width of a stretch film for wrapping a palletized load. Each of the adjustment arms has a captive nut, a stud, a guide, and an adjustment knob. The captive nut is coupled to and configured to translate along the support bar. The stud has a fixed end coupled to the captive nut and a free end extending away from the support bar. The guide has a cylindrical body with an aperture extending through the cylindrical body and a support flange extending outward from the cylindrical body. The stud extends through the aperture. The adjustment knob is coupled to the free end of the stud. The location of each of the adjustment arms along the support bar is adjustable.

20 Claims, 14 Drawing Sheets

(56) References Cited

U.S. PATENT DOCUMENTS

| | | | | |
|---|---|---|---|---|
| 4,409,776 | A | 10/1983 | Usui | |
| 4,468,922 | A | 9/1984 | McCrady | |
| 4,530,473 | A | 7/1985 | Parry | |
| 4,619,102 | A | 10/1986 | Geisinger | |
| 4,671,043 | A | 6/1987 | Forni | |
| 4,723,393 | A | 2/1988 | Silbernagel | |
| 4,739,945 | A | 4/1988 | Yokoe | |
| 4,754,594 | A | 7/1988 | Lancaster | |
| 4,807,427 | A | 2/1989 | Casteel | |
| 4,827,700 | A | 5/1989 | Rampe | |
| 4,845,920 | A | 7/1989 | Lancaster | |
| 4,905,448 | A | 3/1990 | Plitt | |
| 4,905,451 | A | 3/1990 | Jaconelli | |
| 4,961,306 | A | 10/1990 | Sawhney | |
| 5,031,771 | A | 7/1991 | Lancaster | |
| 5,079,898 | A | 1/1992 | Springs | |
| 5,107,657 | A | 4/1992 | Diehl | |
| 5,125,209 | A | 6/1992 | Thimon | |
| 5,168,685 | A | 12/1992 | Suzuki | |
| 5,195,297 | A | 3/1993 | Lancaster | |
| 5,203,939 | A | 4/1993 | Sperling | |
| 5,211,353 | A | 5/1993 | Lewin | |
| 5,307,609 | A | 5/1994 | Kurata | |
| 5,315,808 | A | 5/1994 | MacIvor | |
| 5,358,594 | A | 10/1994 | Darrieux | |
| 5,385,001 | A | 1/1995 | Ramer | |
| 5,409,177 | A | 4/1995 | Parry | |
| 5,447,009 | A | 9/1995 | Oleksy | |
| 5,535,962 | A | 7/1996 | Bargowski | |
| 5,561,971 | A | 10/1996 | Sampson | |
| 5,653,293 | A | 8/1997 | Ellis | |
| 5,797,246 | A | 8/1998 | Martin-Cocher | |
| 5,819,503 | A | 10/1998 | Lancaster, III | |
| 5,965,262 | A | 10/1999 | Whisler | |
| 6,065,269 | A | 5/2000 | Malnati | |
| 6,102,313 | A | 8/2000 | Salzsauler | |
| 6,164,047 | A | 12/2000 | Rossi | |
| 6,311,459 | B1 | 11/2001 | Rossi | |
| 6,393,808 | B1 | 5/2002 | Kallner | |
| 6,688,076 | B1 | 2/2004 | Rivera, Jr. | |
| 6,745,544 | B2 | 6/2004 | Matsumoto | |
| 6,775,956 | B1 | 8/2004 | Lacey | |
| 6,796,105 | B2 | 9/2004 | Rossi | |
| 6,883,298 | B2 | 4/2005 | Gooding | |
| 6,892,515 | B2 | 5/2005 | Cere | |
| 6,971,220 | B1 | 12/2005 | Rampp | |
| 7,029,206 | B2 | 4/2006 | Stockstill | |
| 7,269,935 | B2 | 9/2007 | Jafari | |
| 7,581,368 | B1 | 9/2009 | Bison | |
| 7,621,107 | B2 | 11/2009 | Vanderheiden | |
| 7,908,831 | B1 | 3/2011 | Dugan | |
| 8,046,975 | B1 | 11/2011 | Bison | |
| 8,053,056 | B2 | 11/2011 | Heikaus | |
| 8,276,349 | B2 | 10/2012 | Van Amstel | |
| 8,528,615 | B2 | 9/2013 | Colson | |
| 8,549,819 | B1 * | 10/2013 | Bison | B65B 11/585 53/399 |
| 8,637,134 | B1 | 1/2014 | Aronsen | |
| 8,707,664 | B1 | 4/2014 | Bison | |
| 8,984,848 | B2 | 3/2015 | Bison | |
| 9,254,931 | B2 | 2/2016 | Bison | |
| 9,802,722 | B1 | 10/2017 | Bison | |
| 10,279,945 | B2 | 5/2019 | Nelson | |
| 10,526,099 | B2 | 1/2020 | Bison | |
| 10,960,998 | B2 | 3/2021 | Nicholson | |
| 11,434,029 | B1 | 9/2022 | Bison | |
| 11,628,959 | B1 | 4/2023 | Bison | |
| 2004/0244336 | A1 | 12/2004 | Suolahti | |
| 2005/0123721 | A1 | 6/2005 | Heikaus | |
| 2008/0066431 | A1 | 3/2008 | Cousins | |
| 2008/0092489 | A1 | 4/2008 | Smith | |
| 2008/0209859 | A1 | 9/2008 | Vanderheiden | |
| 2009/0178374 | A1 | 7/2009 | Lancaster, III | |
| 2009/0277136 | A1 | 11/2009 | Van Amstel | |
| 2009/0293425 | A1 | 12/2009 | Carter | |
| 2011/0088359 | A1 | 4/2011 | Brocard | |
| 2012/0102887 | A1 | 5/2012 | Lancaster, III | |
| 2013/0104754 | A1 | 5/2013 | Van Amstel | |
| 2013/0326999 | A1 | 12/2013 | Lemieux | |
| 2014/0331609 | A1 | 11/2014 | Bison | |
| 2015/0197355 | A1 | 7/2015 | Bison | |
| 2015/0353220 | A1 | 12/2015 | Lancaster, III | |
| 2016/0098171 | A1 | 4/2016 | Lancaster, III | |
| 2017/0101205 | A1 | 4/2017 | Schieck | |
| 2018/0208339 | A1 | 7/2018 | Bison | |
| 2018/0257799 | A1 | 9/2018 | Ragsdale | |
| 2019/0084703 | A1 | 3/2019 | Nicholson | |
| 2020/0299016 | A1 | 9/2020 | Lancaster, III | |
| 2020/0377250 | A1 | 12/2020 | Lancaster, III | |

FOREIGN PATENT DOCUMENTS

| | | | | |
|---|---|---|---|---|
| EP | 0178145 | A1 | 4/1986 | |
| EP | 1332968 | A1 | 8/2003 | |
| EP | 1803345 | A1 | 7/2007 | |
| EP | 2589540 | A1 | 5/2013 | |
| EP | 3070003 | A1 * | 9/2016 | B65B 11/006 |
| GB | 2241484 | A | 9/1991 | |
| JP | H0245309 | | 2/1990 | |
| JP | H04215903 | | 8/1992 | |
| JP | H04327108 | | 11/1992 | |
| JP | H10129609 | | 5/1998 | |
| JP | 10129609 | A | 5/1999 | |
| JP | 2000302102 | A | 10/2000 | |
| JP | 2002166905 | A | 6/2002 | |
| JP | 2002211502 | A | 7/2002 | |
| JP | 2002225806 | A | 8/2002 | |
| JP | 2002225807 | A | 8/2002 | |
| WO | 9012737 | A1 | 11/1990 | |
| WO | 2009155713 | A2 | 12/2009 | |

OTHER PUBLICATIONS

JPO machine translation of JP 2002-225806 A, Aug. 14, 2013 15 pages.

USPTO translation of JP 2-45309 A, Aug. 13, 2013 7 pages.

* cited by examiner

SHIPPING PALLET WRAPPING SYSTEM

CROSS REFERENCE TO RELATED APPLICATIONS

This application is a continuation application of U.S. Non-provisional patent application Ser. No. 17/222,843, titled "Shipping Pallet Wrapping System" to Darrel Bison that was filed on Apr. 5, 2021, which application claims the benefit of the filing date of U.S. Provisional Patent Application 63/004,651 entitled "Shipping Pallet Wrapping System" to Darrel Bison that was filed on Apr. 3, 2020, the disclosures of each of which are hereby incorporated herein by this reference.

TECHNICAL FIELD

Aspects of this document relate generally to a shipping pallet wrapping system, and more specifically to a shipping pallet wrapping system with an improved adjustment arm for increased durability and functionality.

BACKGROUND

Some conventional pallet wrapping apparatuses include adjustment arms attached to a support bar through a bracket and hexagonal nut screws. However, these adjustment arms are susceptible to failure due to the stresses regularly experienced during use. In addition, adjusting these adjustment arms requires significant time and specialized tools. Thus, a need exists for an improved adjustment arm with increased durability and functionality.

SUMMARY

Aspects of this document relate to a shipping pallet wrapping system comprising a support bar extending up from a base, the support bar having a channel extending parallel to a length of the support bar for a majority of the length of the support bar, and at least two adjustment arms coupled to the support bar through the channel and configured to narrow a width of a stretch film for wrapping a palletized load, each of the at least two adjustment arms comprising a captive nut positioned within and configured to translate along the channel, wherein the captive nut comprises a first threaded hole extending therethrough and the channel has a lip configured to retain the captive nut within the channel, an externally threaded stud having a fixed end threadedly coupled with the captive nut and a free end extending away from the support bar perpendicular to the support bar, a guide base having a first side with a raised central ridge protruding into the channel, a second side with a retention barrier, and a stud aperture extending through the first side and the second side, wherein the stud extends through the stud aperture and the retention barrier comprises a raised lip surrounding the stud aperture, a guide having a cylindrical body with a first end nested within the retention barrier and a second end distal to the first end, a central aperture extending through a center of the cylindrical body and aligned with the stud aperture of the guide base, and a support flange extending radially outward from the second end of the cylindrical body, the support flange having a recess, wherein the stud extends through the central aperture, a sleeve surrounding the cylindrical body and configured to rotate freely about the cylindrical body, and an adjustment knob nested within the recess of the support flange, the adjustment knob having a first side with a second threaded hole aligned with the central aperture and the stud aperture and threadedly coupled with the free end of the stud, and a second side with a grip configured to facilitate rotation of the adjustment knob by a user, wherein each of the at least two adjustment arms is configured to tighten onto the support bar when a corresponding adjustment knob is rotated in a first direction and to loosen off of the support bar when the corresponding adjustment knob is rotated in a second direction opposite the first direction, and wherein a location of each of the at least two adjustment arms along the channel is adjustable.

Particular embodiments may comprise one or more of the following features. The shipping pallet wrapping system may further comprise a roller separated from the support bar and extending up from the base parallel to the support bar, wherein the roller is configured to guide the stretch film to pass between the at least two adjustment arms. The shipping pallet wrapping system may further comprise at least one spool extending up from the base and supporting at least one roll of the stretch film on a first side of the support bar, the at least one roll of stretch film configured to supply the stretch film to the at least two adjustment arms. The shipping pallet wrapping system may further comprise a pre-stretch carriage on a second side of the support bar, the pre-stretch carriage supported by the base and configured to receive the stretch film from the at least two adjustment arms and stretch the stretch film in preparation for wrapping the palletized load.

Aspects of this document relate to a shipping pallet wrapping system comprising a support bar extending from a base, the support bar having a channel extending parallel to a length of the support bar for a majority of the length of the support bar, and at least two adjustment arms coupled to the support bar and configured to narrow a width of a stretch film for wrapping a palletized load, each of the at least two adjustment arms comprising a captive nut positioned within and configured to translate along the channel, wherein the captive nut comprises a first threaded hole extending therethrough and the channel is configured to retain the captive nut within the channel, a threaded stud having a fixed end threadedly coupled with the captive nut and a free end extending away from the support bar, a guide base adjacent the support bar, the guide base having a stud aperture extending through the guide base, wherein the stud extends through the stud aperture, a guide having a cylindrical body with a first end adjacent the guide base and a second end distal to the first end, a central aperture extending through a center of the cylindrical body and aligned with the stud aperture of the guide base, wherein the stud extends through the central aperture, a sleeve surrounding the cylindrical body and configured to rotate freely about the cylindrical body, and an adjustment knob having a second threaded hole aligned with the central aperture and the stud aperture and threadedly coupled with the free end of the stud, wherein a location of each of the at least two adjustment arms along the channel is adjustable.

Particular embodiments may comprise one or more of the following features. A first side of the guide base may have a raised central ridge protruding into the channel. A second side of the guide base may have a retention barrier with a raised lip surrounding the stud aperture, wherein the first end of the cylindrical body of the guide is nested within the retention barrier. The guide may further have a support flange with a recess, the support flange extending radially outward from the second end of the cylindrical body, wherein the adjustment knob is nested within the recess of the support flange. The adjustment knob may further have a grip configured to facilitate rotation of the adjustment knob by a user. Each of the at least two adjustment arms may be configured to tighten onto the support bar when a corresponding adjustment knob is rotated in a first direction and to loosen off of the support bar when the corresponding adjustment knob is rotated in a second direction opposite the first direction.

Aspects of this document relate to a shipping pallet wrapping system comprising a support bar extending from a base, and at least one adjustment arm coupled to the support bar and configured to narrow a width of a stretch film for wrapping a palletized load, each of the at least one adjustment arm comprising a captive nut coupled to and configured to translate along the support bar, a stud having a fixed end coupled with the captive nut and a free end extending away from the support bar, a guide having a cylindrical body with a central aperture extending through the cylindrical body, wherein the stud extends through the central aperture, and an adjustment knob aligned with the central aperture and coupled with the free end of the stud, wherein a location of each of the at least one adjustment arm along the support bar is adjustable.

Particular embodiments may comprise one or more of the following features. The shipping pallet wrapping system may further comprise a guide base having a first side adjacent the support bar, a second side opposite the first side, and a stud aperture extending through the first side and the second side, wherein the stud extends through the stud aperture. The first side of the guide base may have a raised central ridge protruding toward the support bar. The second side of the guide base may have a retention barrier with a raised lip surrounding the stud aperture, wherein the first end of the cylindrical body of the guide is nested within the retention barrier. The shipping pallet wrapping system may further comprise a sleeve surrounding the cylindrical body and configured to rotate freely about the cylindrical body. The guide may further have a support flange with a recess, the support flange extending radially outward from a second end of the cylindrical body distal to the support bar, wherein the adjustment knob is nested within the recess of the support flange. Each of the at least one adjustment arm may be configured to tighten onto the support bar when a corresponding adjustment knob is rotated in a first direction and to loosen off of the support bar when the corresponding adjustment knob is rotated in a second direction opposite the first direction. The shipping pallet wrapping system may further comprise a pre-stretch carriage on a second side of the support bar, the pre-stretch carriage supported by the base and configured to receive the stretch film from the at least one adjustment arm and stretch the stretch film in preparation for wrapping the palletized load. The shipping pallet wrapping system may further comprise at least one spool extending from the base and supporting at least one roll of the stretch film on a first side of the support bar, the at least one roll of stretch film configured to supply the stretch film to the at least one adjustment arm. The shipping pallet wrapping system may further comprise at least one blade positioned between the at least one roll of the stretch film and the at least one adjustment arm, wherein the at least one blade is configured to cut the stretch film as the stretch film moves from the at least one spool to the at least one adjustment arm.

The foregoing and other aspects, features, applications, and advantages will be apparent to those of ordinary skill in the art from the specification, drawings, and the claims. Unless specifically noted, it is intended that the words and phrases in the specification and the claims be given their plain, ordinary, and accustomed meaning to those of ordinary skill in the applicable arts. The inventors are fully aware that they can be their own lexicographers if desired. The inventors expressly elect, as their own lexicographers, to use only the plain and ordinary meaning of terms in the specification and claims unless they clearly state otherwise and then further, expressly set forth the "special" definition of that term and explain how it differs from the plain and ordinary meaning. Absent such clear statements of intent to apply a "special" definition, it is the inventors' intent and desire that the simple, plain and ordinary meaning to the terms be applied to the interpretation of the specification and claims.

The inventors are also aware of the normal precepts of English grammar. Thus, if a noun, term, or phrase is intended to be further characterized, specified, or narrowed in some way, then such noun, term, or phrase will expressly include additional adjectives, descriptive terms, or other modifiers in accordance with the normal precepts of English grammar. Absent the use of such adjectives, descriptive terms, or modifiers, it is the intent that such nouns, terms, or phrases be given their plain, and ordinary English meaning to those skilled in the applicable arts as set forth above.

Further, the inventors are fully informed of the standards and application of the special provisions of 35 U.S.C. § 112(f). Thus, the use of the words "function," "means" or "step" in the Detailed Description or Description of the Drawings or claims is not intended to somehow indicate a desire to invoke the special provisions of 35 U.S.C. § 112(f), to define the invention. To the contrary, if the provisions of 35 U.S.C. § 112(f) are sought to be invoked to define the inventions, the claims will specifically and expressly state the exact phrases "means for" or "step for", and will also recite the word "function" (i.e., will state "means for performing the function of [insert function]"), without also reciting in such phrases any structure, material or act in support of the function. Thus, even when the claims recite a "means for performing the function of . . . " or "step for performing the function of . . . ," if the claims also recite any structure, material or acts in support of that means or step, or that perform the recited function, then it is the clear intention of the inventors not to invoke the provisions of 35 U.S.C. § 112(f). Moreover, even if the provisions of 35 U.S.C. § 112(f) are invoked to define the claimed aspects, it is intended that these aspects not be limited only to the specific structure, material or acts that are described in the preferred embodiments, but in addition, include any and all structures, materials or acts that perform the claimed function as described in alternative embodiments or forms of the disclosure, or that are well known present or later-developed, equivalent structures, material or acts for performing the claimed function.

The foregoing and other aspects, features, and advantages will be apparent to those of ordinary skill in the art from the specification, drawings, and the claims.

BRIEF DESCRIPTION OF THE DRAWINGS

Implementations will hereinafter be described in conjunction with the appended drawings, where like designations denote like elements, and.

Figure 1:
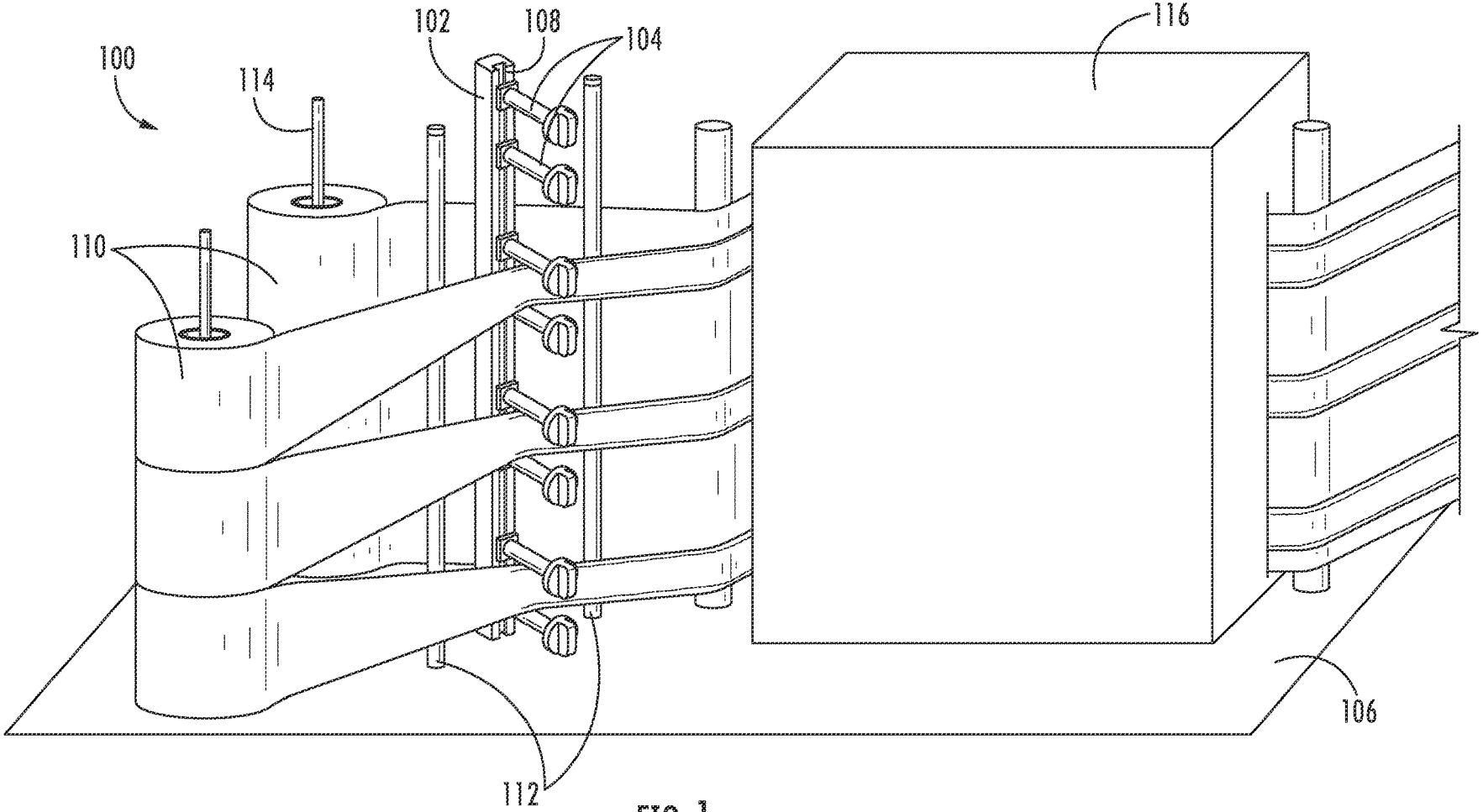
FIG. 1 is a perspective view of a shipping pallet wrapping system.

Skilled artisans will appreciate that elements in the figures are illustrated for simplicity and clarity and have not necessarily been drawn to scale. For example, the dimensions of some of the elements in the figures may be exaggerated relative to other elements to help to improve understanding of implementations.

DETAILED DESCRIPTION

This disclosure, its aspects and implementations, are not limited to the specific material types, components, methods, or other examples disclosed herein. Many additional material types, components, methods, and procedures known in the art are contemplated for use with particular implementations from this disclosure. Accordingly, for example, although particular implementations are disclosed, such implementations and implementing components may comprise any components, models, types, materials, versions, quantities, and/or the like as is known in the art for such systems and implementing components, consistent with the intended operation.

The word "exemplary," "example," or various forms thereof are used herein to mean serving as an example, instance, or illustration. Any aspect or design described herein as "exemplary" or as an "example" is not necessarily to be construed as preferred or advantageous over other aspects or designs. Furthermore, examples are provided solely for purposes of clarity and understanding and are not meant to limit or restrict the disclosed subject matter or relevant portions of this disclosure in any manner. It is to be appreciated that a myriad of additional or alternate examples of varying scope could have been presented, but have been omitted for purposes of brevity.

While this disclosure includes a number of implementations that are described in many different forms, there is shown in the drawings and will herein be described in detail particular implementations with the understanding that the present disclosure is to be considered as an exemplification of the principles of the disclosed methods and systems, and is not intended to limit the broad aspect of the disclosed concepts to the implementations illustrated.

In the following description, reference is made to the accompanying drawings which form a part hereof, and which show by way of illustration possible implementations. It is to be understood that other implementations may be utilized, and structural, as well as procedural, changes may be made without departing from the scope of this document. As a matter of convenience, various components will be described using exemplary materials, sizes, shapes, dimensions, and the like. However, this document is not limited to the stated examples and other configurations are possible and within the teachings of the present disclosure. As will become apparent, changes may be made in the function and/or arrangement of any of the elements described in the disclosed exemplary implementations without departing from the spirit and scope of this disclosure.

Figure 2:
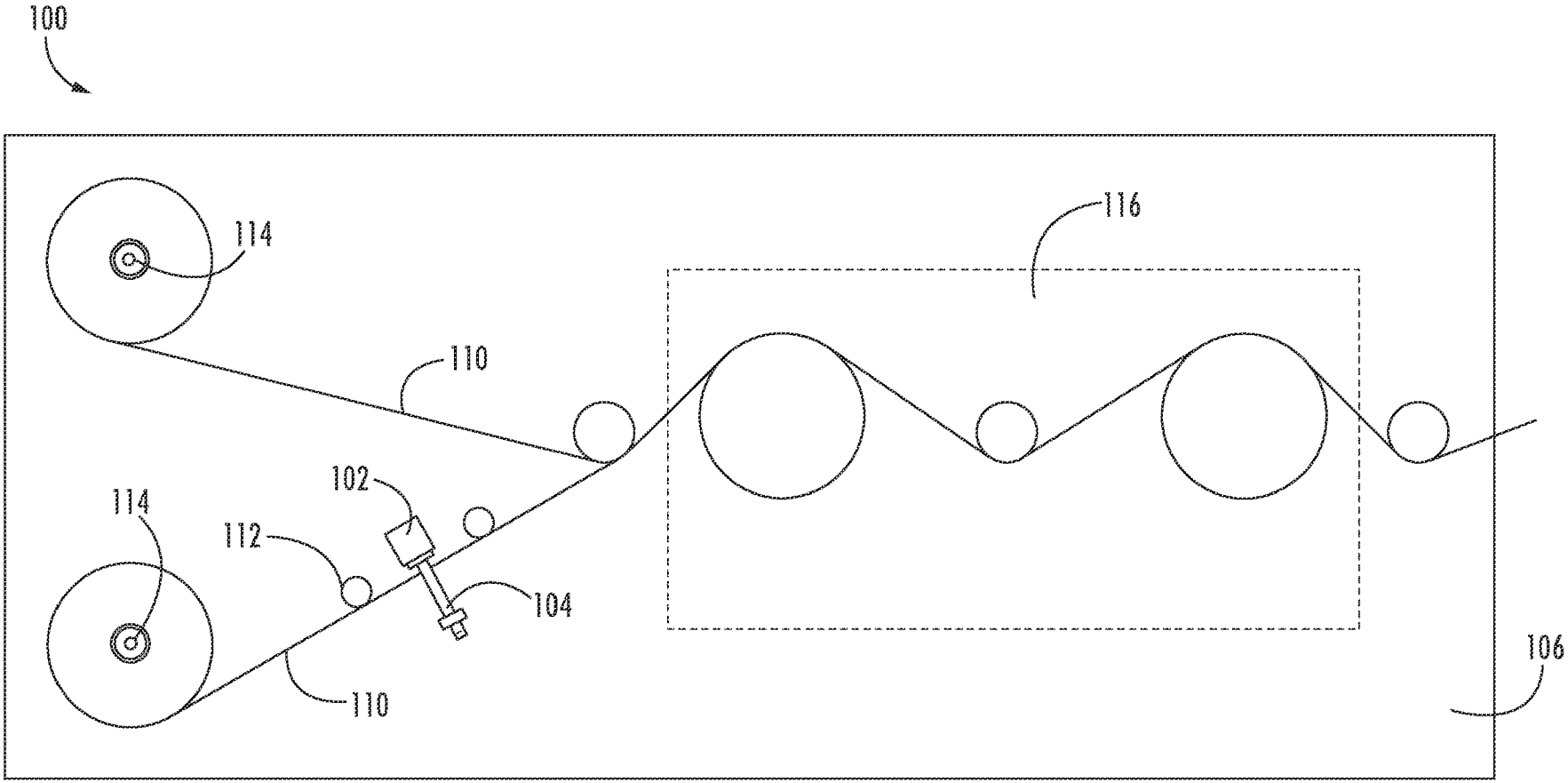
FIG. 2 is a top view of the shipping pallet wrapping system shown in FIG. 1.
Figure 3:
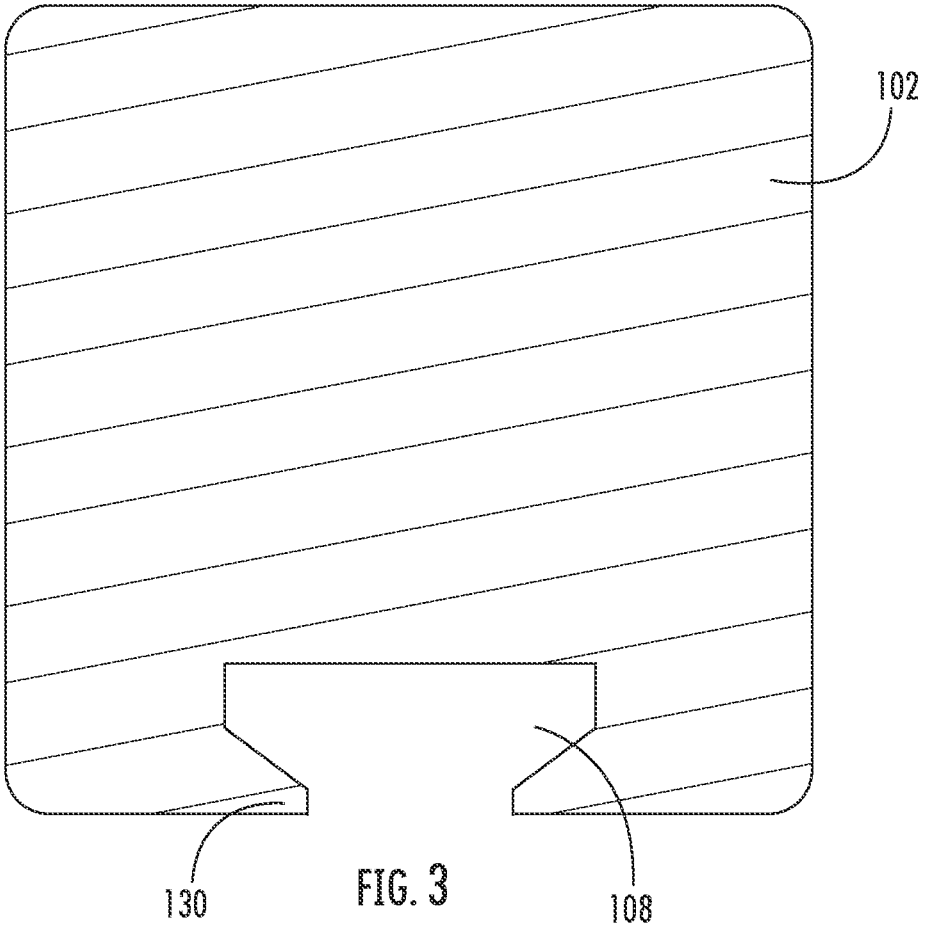
FIG. 3 is a cross section view of the support bar of the shipping pallet wrapping system shown in FIG. 1.

The present disclosure relates to a shipping pallet wrapping system 100 that is configured to wrap a palletized load. The shipping pallet wrapping system 100 has a support bar 102 and at least one adjustment arm 104, as shown in FIGS. 1-2. The support bar 102 extends up from a base 106, and may have a channel 108 that extends parallel to a length of the support bar 102 for a majority of the length of the support bar 102 (see FIG. 3). The adjustment arms 104 are coupled to the support bar 102 and are configured to narrow the width of a stretch film 110 for wrapping a palletized load. The shipping pallet wrapping system 100 additionally may have a roller 112, at least one spool 114, and a pre-stretch carriage 116. The roller 112 is separated from the support bar 102, and extends up from the base 106 parallel to the support bar 102. The roller 112 is configured to guide the stretch film to pass between the adjustment arms 104. The at least one spool 114 extends up from the base 106 and supports at least one roll of the stretch film 110. The at least one spool 114 may be located on a first side of the support bar 102, and the at least one roll of stretch film 110 is configured to supply the stretch film 110 to the adjustment arms 104. A blade may be positioned between the roll of stretch film 110 and the adjustment arms 104 and may be configured to cut the stretch film 110 as the stretch film 110 moves from the spool 114 to the adjustment arms 104. The pre-stretch carriage 116 may be on a second side of the support bar 102 opposite the first side, is supported by the base 106, and is configured to receive the stretch film 110 from the adjustment arms 104 and stretch the stretch film 110 in preparation for wrapping the palletized load.

Figure 4:
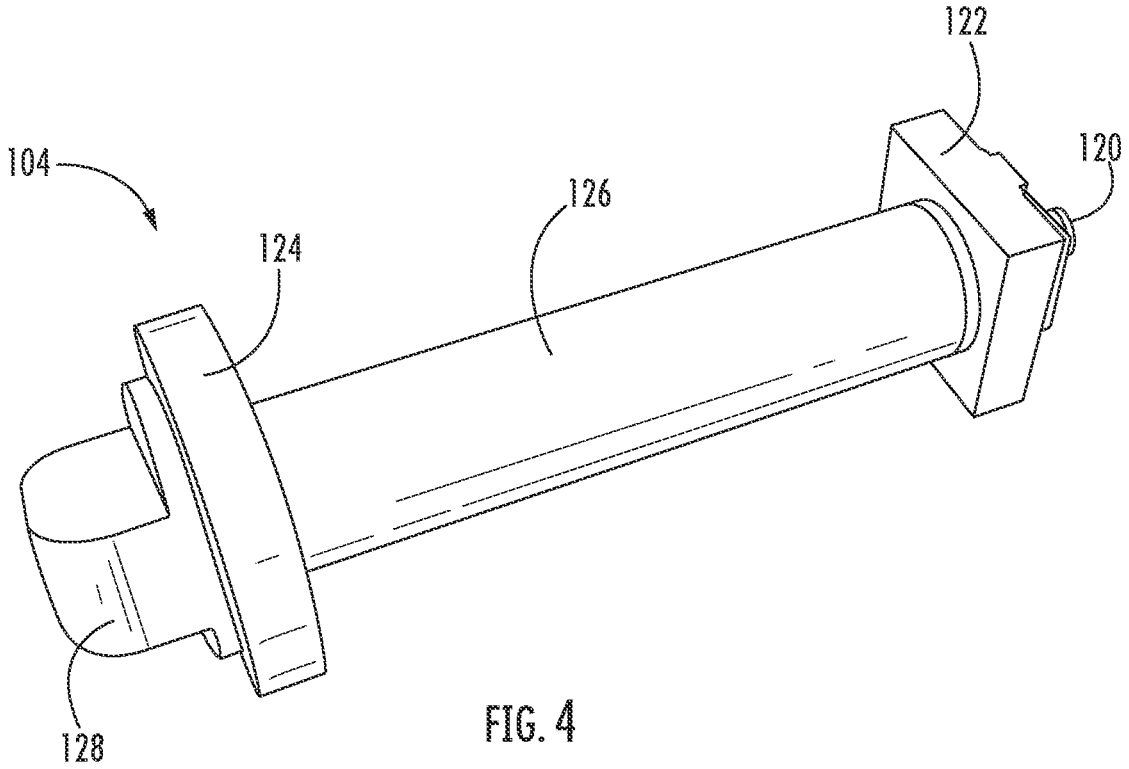
FIG. 4 is a perspective view of an adjustment arm of the shipping pallet wrapping system shown in FIG. 1.
Figure 5:
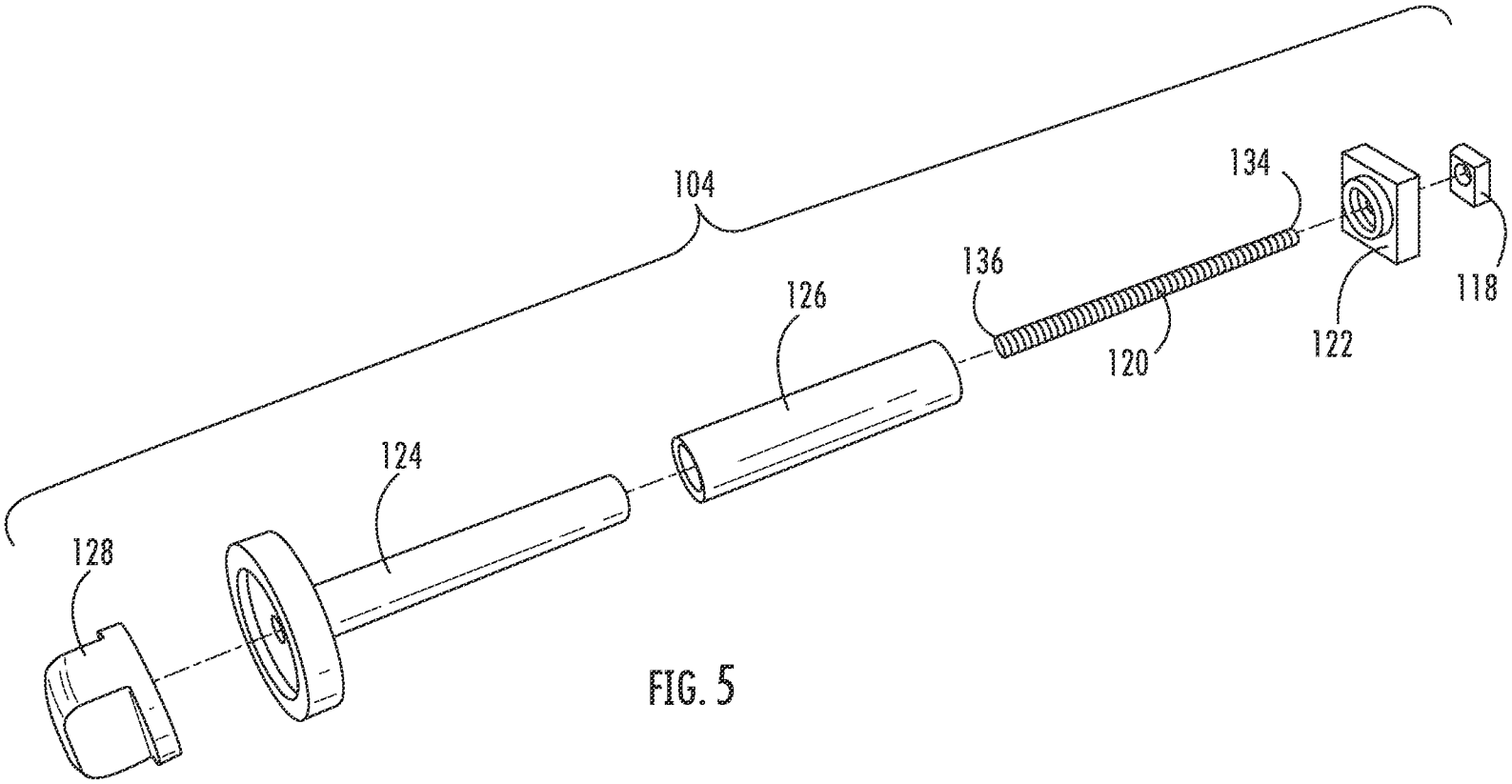
FIG. 5 is an exploded view of the adjustment arm shown in FIG. 4.
Figure 6:
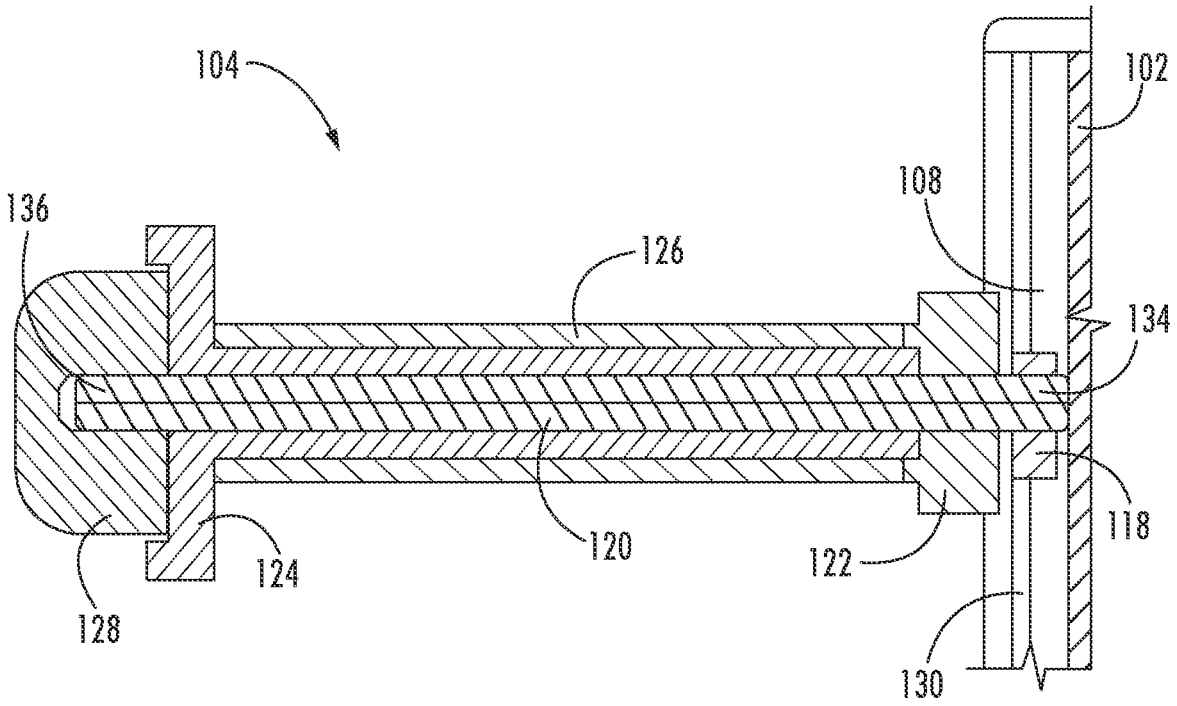
FIG. 6 is a cross section view of the adjustment arm shown in FIG. 4.
Figure 7:
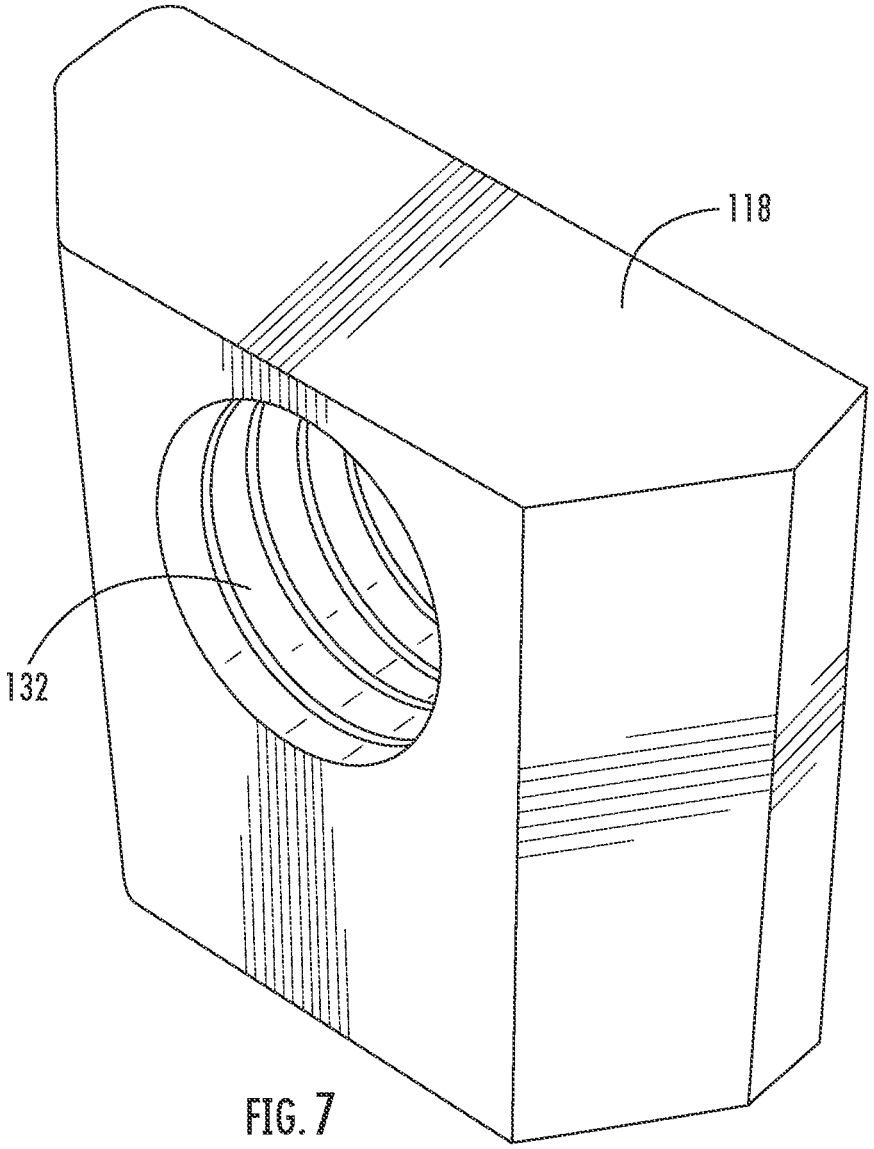
FIG. 7 is a first perspective view of the captive nut of the adjustment arm shown in FIG. 4.
Figure 8:
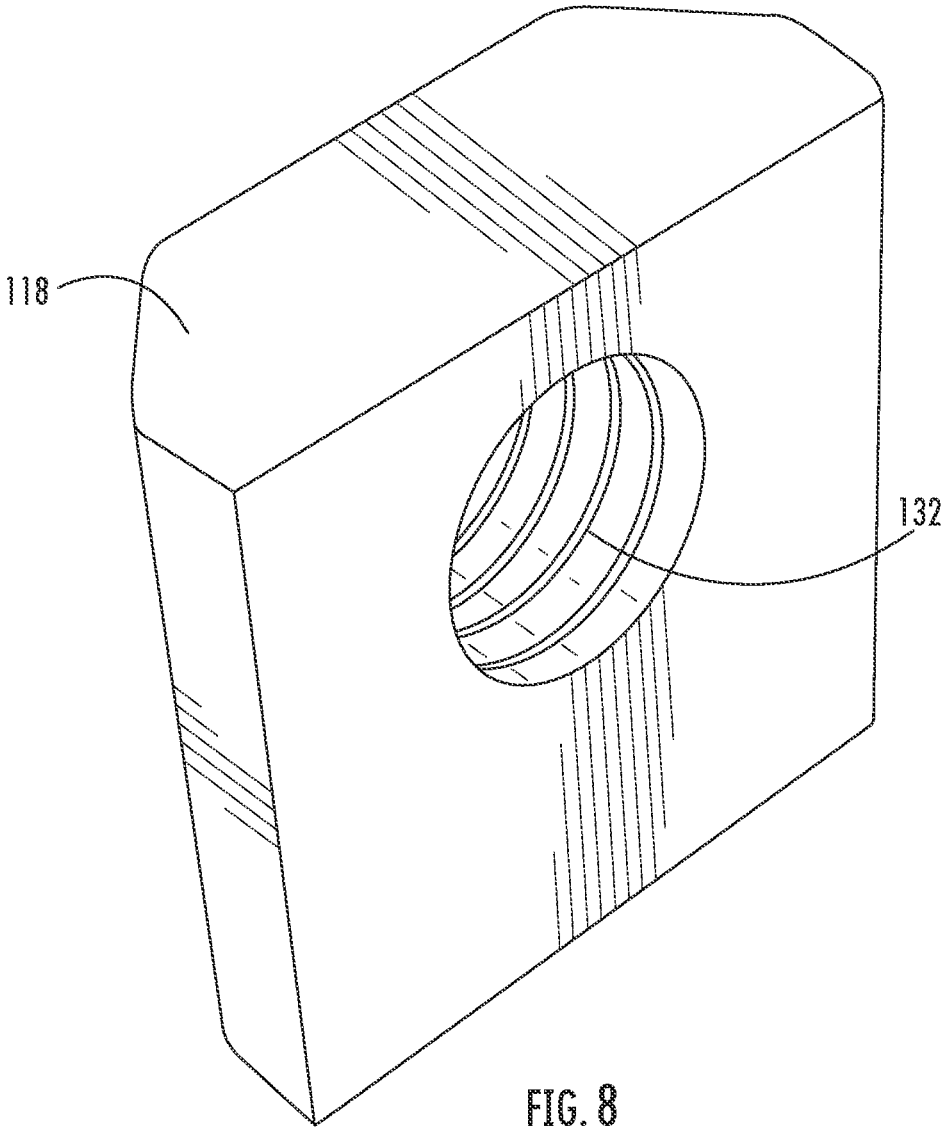
FIG. 8 is a second perspective view of the captive nut shown in FIG. 7.

Each of the adjustment arms 104 may comprise a captive nut 118, a stud 120, a guide base 122, a guide 124, a sleeve 126 and an adjustment knob 128, as shown in FIGS. 4-6. The captive nut 118 is coupled to and configured to translate along the support bar 102. In some embodiments, the captive nut 118 may be positioned within the channel 108 and the channel 108 may have a lip 130 configured to retain the captive nut 118 within the channel 108 (see FIG. 3). The captive nut 118 may be coupled to the support bar 102 in some other way. For example, the captive nut 118 may be configured to extend around the support bar 102 as a sleeve. In some embodiments, the captive nut 118 has a first hole 132 coupled with the stud 120. As shown in FIGS. 7-8, the first hole 132 may be threaded, and is configured to receive the stud 120. When the stud 120 is inserted further into the first hole 132, either by moving along the threads of the first hole 132 or by some other mechanism, the captive nut 118 tightens into place against the support bar 102, thus temporarily fixing the adjustment arm 104 into place. The embodiment of the captive nut 118 shown in FIGS. 7-8 is rectangular in shape and has a cross section that matches the shape of the channel 108 (see FIG. 3). Other embodiments of the captive nut 118 may be any other shape, and may even be a sleeve, as disclosed above.

The stud 120 has a fixed end 134 coupled to the captive nut 118 and a free end 136 extending away from the support bar 102. The stud 120 may be externally threaded along the entirety of its length, may be threaded on the fixed end 134 and the free end 136, but not in the middle, or may not be threaded at all. The stud 120 provides support and connection from the support bar 102 along the length of the adjustment arm 104.

Figure 9:
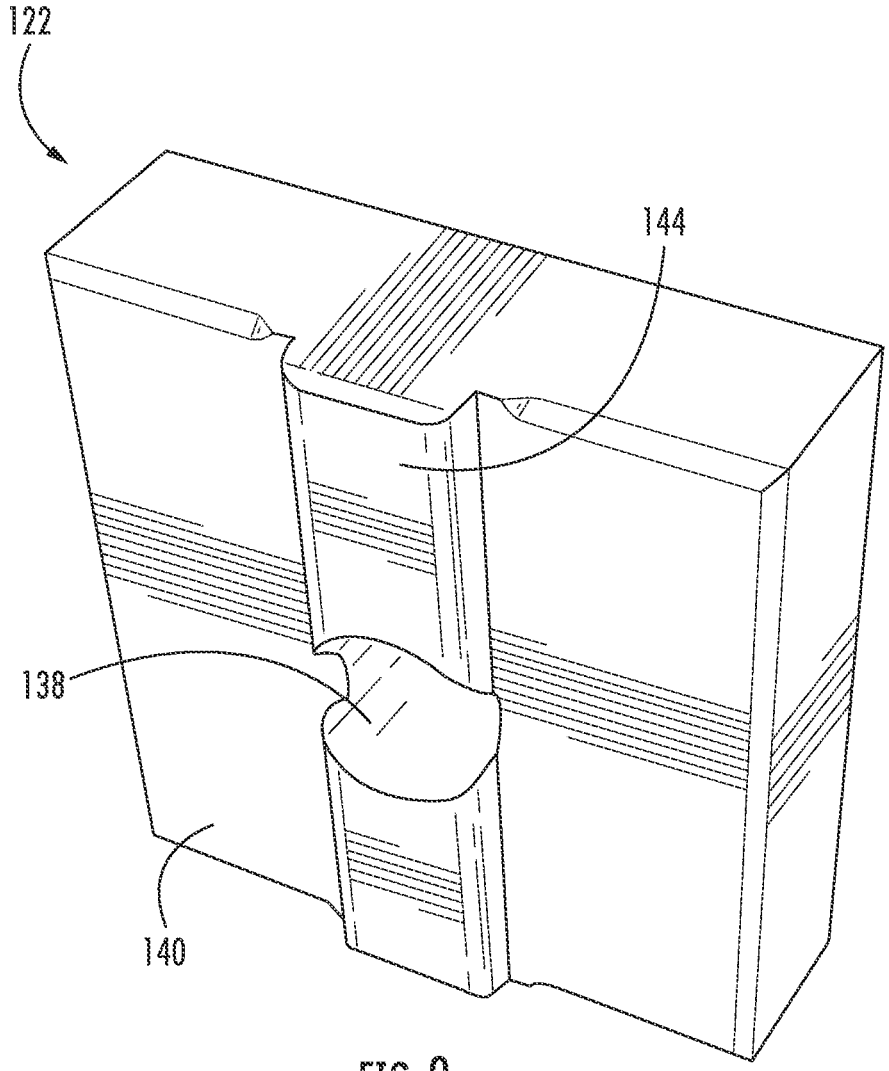
FIG. 9 is a first perspective view of the guide base of the adjustment arm shown in FIG. 4.
Figure 10:
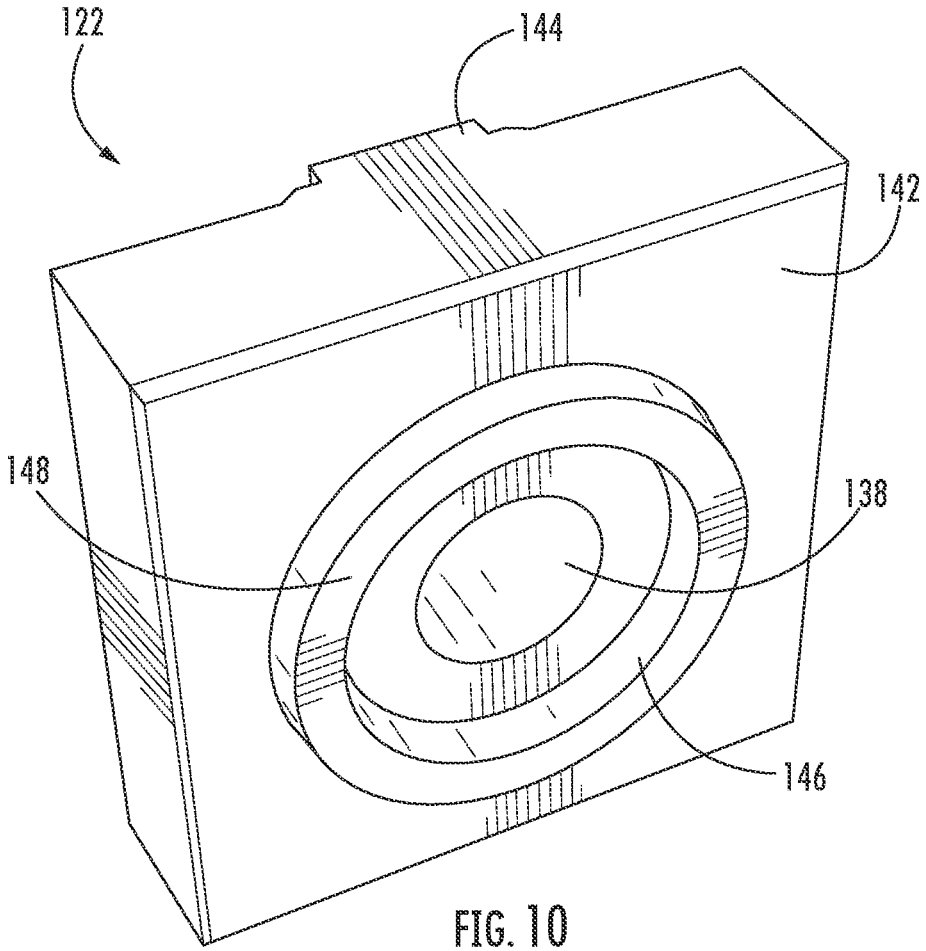
FIG. 10 is a second perspective view of the guide base shown in FIG. 9.

Turning to FIGS. 9-10, the guide base 122 has a stud aperture 138 extending through a first side 140 and a second side 142 of the guide base 122. The stud 120 extends through the stud aperture 138, thus supporting the guide base 122. To provide additional support to the guide base 122 and help keep the adjustment arm 104 aligned, the guide base 122 may have a raised central ridge 144 on the first side 140 of the guide base 122, as shown in FIG. 9. The raised central ridge 144 may protrude into the channel 108 of the support bar 102 (see FIG. 6). Alternatively, the captive nut 118 may have a slot into which the raised central ridge 144 protrudes. The guide base 122 may also have a retention barrier 146 on the second side 142 of the guide base 122, as shown in FIG. 10. The retention barrier 146 is configured to help keep the guide 124 aligned with the stud 120. By maintaining alignment of the various components of the adjustment arm 104, any forces applied to the adjustment arm 104 are more effectively transferred to the support bar 102, thus reducing the potential for damage to the adjustment arm 104 to occur. The retention barrier may comprise a raised lip 148 surrounding the stud aperture 138.

Figure 11:
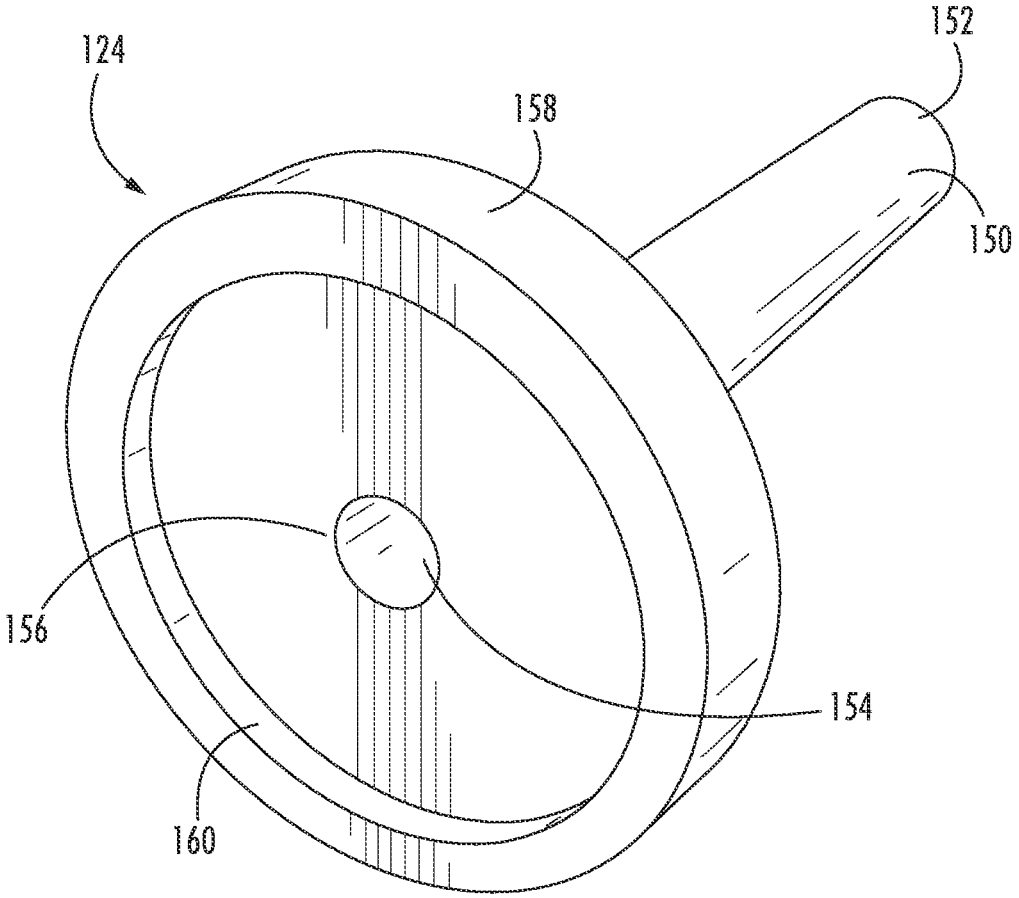
FIG. 11 is a first perspective view of the guide of the adjustment arm shown in FIG. 4.
Figure 12:
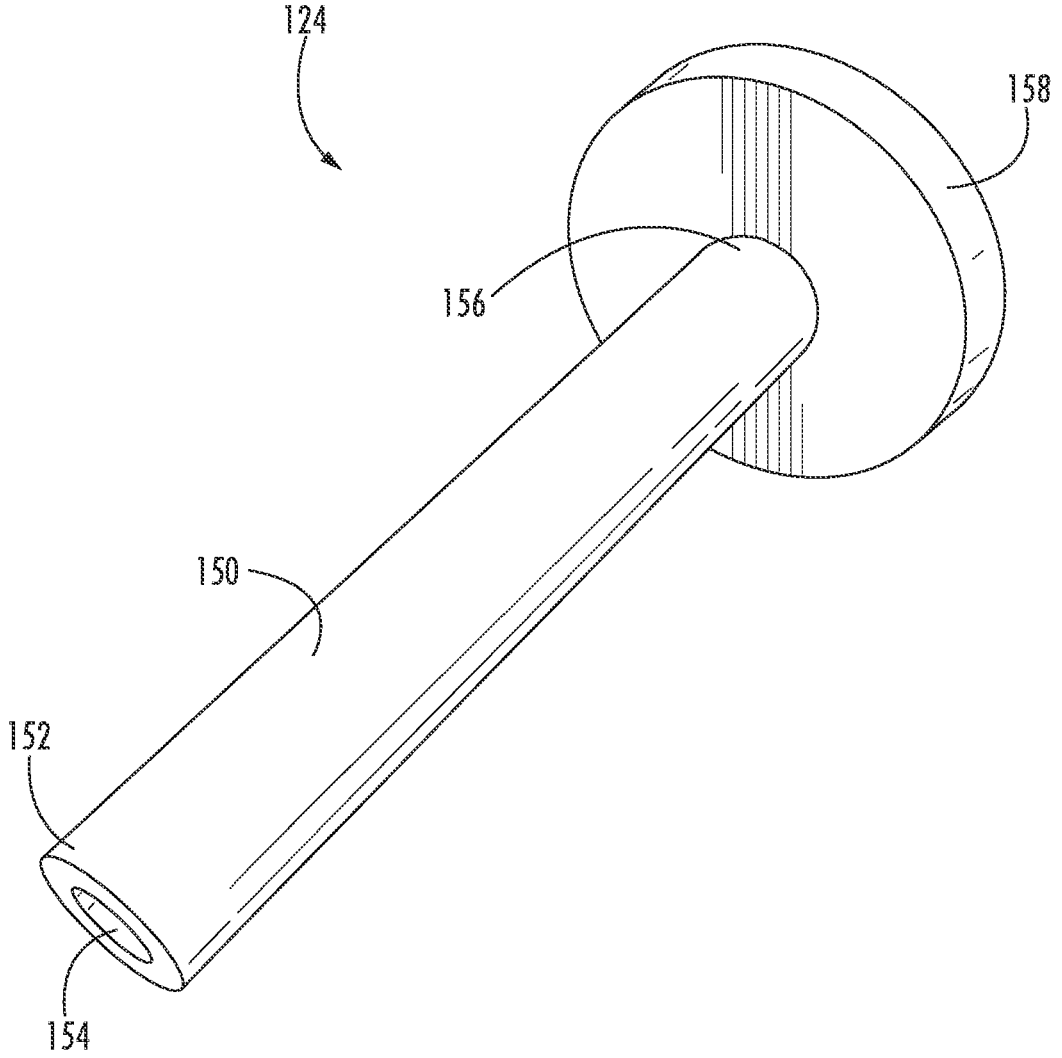
FIG. 12 is a second perspective view of the guide shown in FIG. 11.

Turning to FIG. 11-12, the guide 124 has a cylindrical body 150. The cylindrical body 150 may have a first end 152 nested within the retention barrier 146, helping align the guide 124 with the stud 120 as disclosed above. A central aperture 154 extends through a center of the cylindrical body 150. The central aperture 154 is aligned with the stud aperture 138, and the stud 120 extends through the central aperture 154. The cylindrical body 150 also has a second end 156 distal to the first end 152. A support flange 158 may extend radially outward from the second end 156 of the cylindrical body 150 and may have a recess 160. The support flange 158 and the recess 160 are configured to provide support to the adjustment knob 128 by aligning the adjustment knob 128 with the stud 120, similar to the way that the retention barrier 146 and the raised lip 148 provide support to the cylindrical body 150. As discussed above, this alignment helps to transfer forces applied to the adjustment arm 104 to the support bar 102 and decreases the damage done to the adjustment arm 104. In addition, the support flange 158 helps to retain the stretch film 110 between the adjustment arms 104. The sleeve 126 may surround the cylindrical body 150 and may be configured to rotate freely about the cylindrical body 150. Because the stretch film 110 directly contacts the sleeve 126, this rotation decreases the occurrence of kinetic friction between the stretch film 110 and the sleeve 126, which in turn decreases the likelihood that the stretch film 110 tears during wrapping activity. In addition, the larger diameter of the sleeve 126 improves a smoother roll-over of the edge of the stretch film 110 when narrowing the width of the stretch film 110. As the stretch film 110 passes over the sleeve 126, the edge of the stretch film 110 tends to have a more consistent, wider roll-over edge as compared to stretch film 110 passed over an adjustment arm 104 with a smaller diameter. This more consistent banded edge provides additional strength to the stretch film wrapped around the palletized load.

Figure 13:
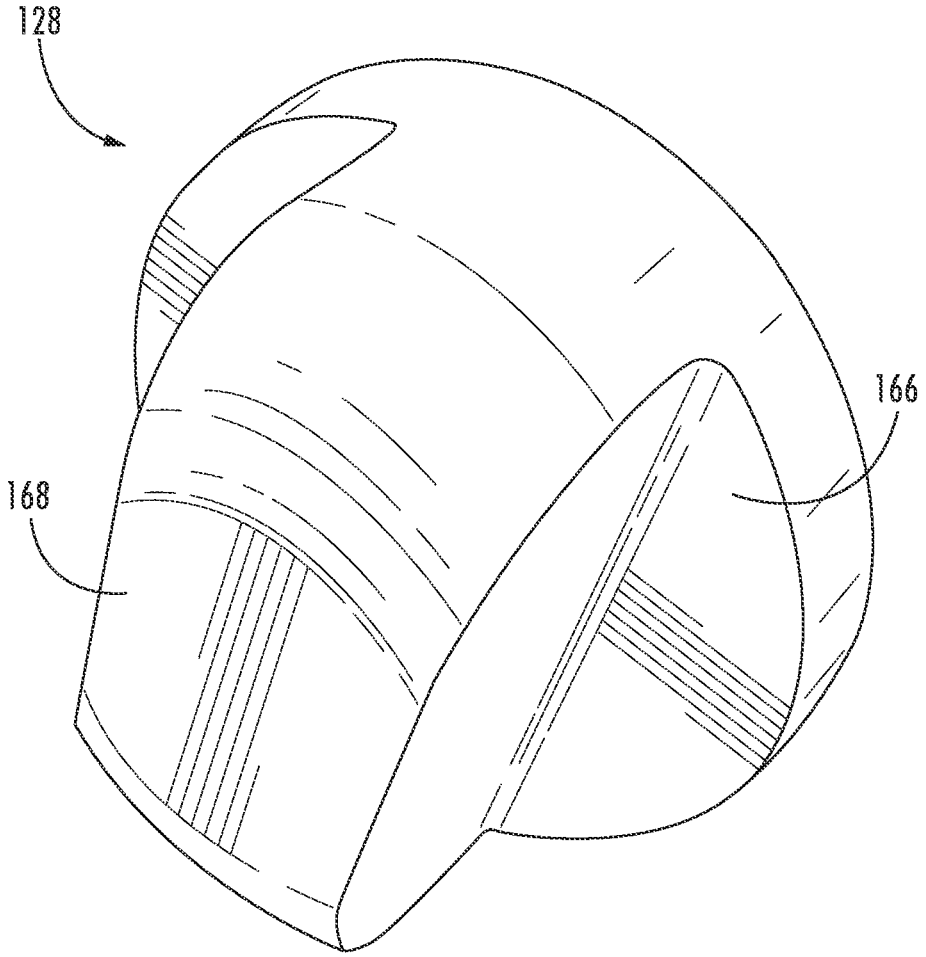
FIG. 13 is a first perspective view of the adjustment knob of the adjustment arm shown in FIG. 4.
Figure 14:
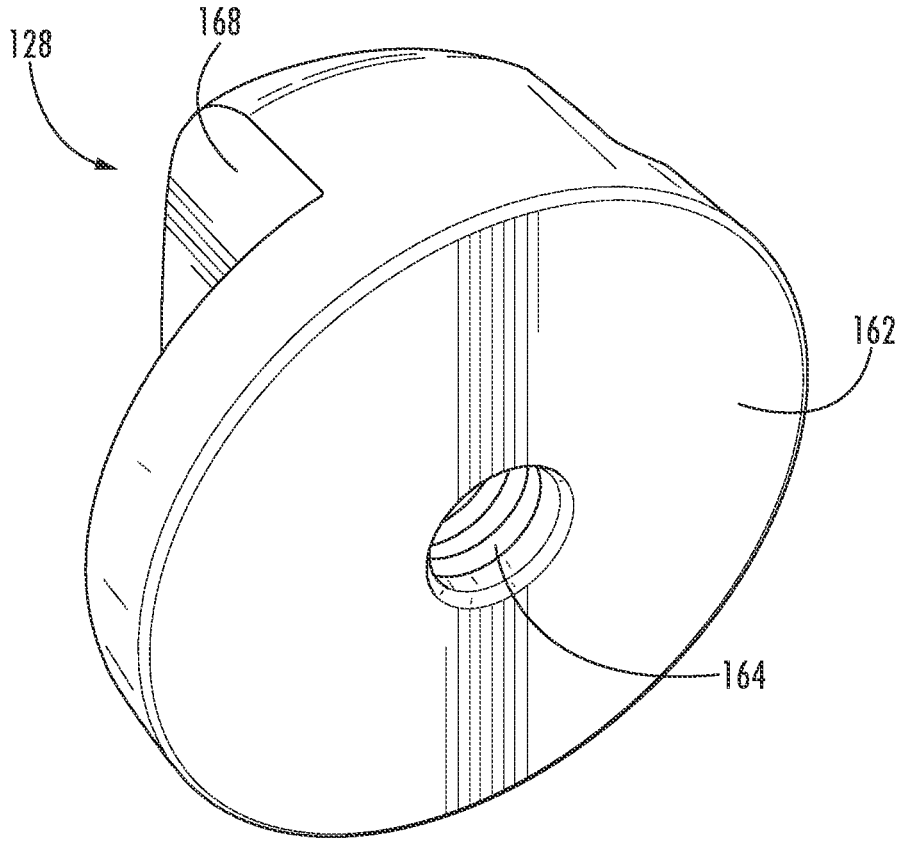
FIG. 14 is a second perspective view of the adjustment knob shown in FIG. 13.

The adjustment knob 128 may be nested within the recess 160 of the support flange 158, providing support to the adjustment knob 128 as discussed above. As shown in FIGS. 13-14, the adjustment knob 128 has a first side 162, which may have a second hole 164. The second hole 164 may be threaded and is aligned with the central aperture 154 and the stud aperture 138. The free end 136 of the stud 120 is coupled to the second hole 164 of the adjustment knob 128 (see FIG. 6). The adjustment knob 128 may also have a second side 166 with a grip 168. The grip 168 is configured to facilitate rotation of the adjustment knob 128 by a user. A benefit of the adjustment knob 128 is that the adjustment knob 128 can be tightened onto the stud 120 without the use of any tools. The grip 168 provides sufficient surfaces for twisting the adjustment knob 128 by hand. These surfaces are also sufficient for use with a tool as well, if the user desires to use a tool.

Each of the adjustment arms 104 is configured to tighten onto the support bar 102 when the corresponding adjustment knob 128 is rotated in a first direction, and to loosen off of the support bar 102 when the corresponding adjustment knob 128 is rotated in a second direction opposite the first direction. Because the adjustment knob 128 is on the free end 136 of the stud 120, which is distal to the support bar 102, the adjustment knob 128 is easily accessible. A location of each of the adjustment arms 104 is adjustable along the support bar 102. Thus, the adjustment knob 128 can be used to loosen the adjustment arm 104, and the adjustment arm 104 can then be moved along the support bar 104 to a new desired location. Once in the new location, the adjustment knob 128 can then be tightened onto the stud 120, and thus onto the support bar 102. Adjusting the position of the adjustment arms 104 can thus be done relatively quickly, saving time and money.

It will be understood that implementations of a shipping pallet wrapping system are not limited to the specific assemblies, devices and components disclosed in this document, as virtually any assemblies, devices and components consistent with the intended operation of a shipping pallet wrapping system may be used. Accordingly, for example, although particular shipping pallet wrapping systems, and other assemblies, devices and components are disclosed, such may include any shape, size, style, type, model, version, class, measurement, concentration, material, weight, quantity, and/or the like consistent with the intended operation of shipping pallet wrapping systems. Implementations are not limited to uses of any specific assemblies, devices and components; provided that the assemblies, devices and components selected are consistent with the intended operation of a shipping pallet wrapping system.

Accordingly, the components defining any shipping pallet wrapping system may be formed of any of many different types of materials or combinations thereof that can readily be formed into shaped objects provided that the materials selected are consistent with the intended operation of a shipping pallet wrapping system. For example, the components may be formed of: polymers such as thermoplastics (such as ABS, Fluoropolymers, Polyacetal, Polyamide; Polycarbonate, Polyethylene, Polysulfone, and/or the like), thermosets (such as Epoxy, Phenolic Resin, Polyimide, Polyurethane, Silicone, and/or the like), any combination thereof, and/or other like materials; glasses (such as quartz glass), carbon-fiber, aramid-fiber, any combination thereof, and/or other like materials; composites and/or other like materials; metals, such as zinc, magnesium, titanium, copper, lead, iron, steel, carbon steel, alloy steel, tool steel, stainless steel, brass, nickel, tin, antimony, pure aluminum, 1100 aluminum, aluminum alloy, any combination thereof, and/or other like materials; alloys, such as aluminum alloy, titanium alloy, magnesium alloy, copper alloy, any combination thereof, and/or other like materials; any other suitable material; and/or any combination of the foregoing thereof. In instances where a part, component, feature, or element is governed by a standard, rule, code, or other requirement, the part may be made in accordance with, and to comply under such standard, rule, code, or other requirement.

Various shipping pallet wrapping systems may be manufactured using conventional procedures as added to and improved upon through the procedures described here. Some components defining a shipping pallet wrapping system may be manufactured simultaneously and integrally joined with one another, while other components may be purchased pre-manufactured or manufactured separately and then assembled with the integral components. Various implementations may be manufactured using conventional procedures as added to and improved upon through the procedures described here.

Accordingly, manufacture of these components separately or simultaneously may involve extrusion, pultrusion, vacuum forming, injection molding, blow molding, resin transfer molding, casting, forging, cold rolling, milling, drilling, reaming, turning, grinding, stamping, cutting, bending, welding, soldering, hardening, riveting, punching, plating, and/or the like. If any of the components are manufactured separately, they may then be coupled with one another in any manner, such as with adhesive, a weld, a fastener (e.g. a bolt, a nut, a screw, a nail, a rivet, a pin, and/or the like), wiring, any combination thereof, and/or the like for example, depending on, among other considerations, the particular material forming the components.

It will be understood that methods for manufacturing or assembling shipping pallet wrapping systems are not limited to the specific order of steps as disclosed in this document. Any steps or sequence of steps of the assembly of a shipping pallet wrapping system indicated herein are given as examples of possible steps or sequence of steps and not as limitations, since various assembly processes and sequences of steps may be used to assemble shipping pallet wrapping systems.

The implementations of a shipping pallet wrapping system described are by way of example or explanation and not by way of limitation. Rather, any description relating to the foregoing is for the exemplary purposes of this disclosure, and implementations may also be used with similar results for a variety of other applications employing a shipping pallet wrapping system.

What is claimed is:

1. A shipping pallet wrapping system, comprising:

a support bar extending from a base; and at least two adjustment arms coupled to the support bar and configured to narrow a width of a stretch film for wrapping a palletized load, each of the at least two adjustment arms comprising:

a stud having a fixed end attached to the support bar and configured to translate along the support bar, and a free end extending away from the support bar, the width of the stretch film engaging at least one of the at least two adjustment arms between the fixed end and the free end of the stud;

a guide having a cylindrical body with a central aperture extending through the cylindrical body, wherein the stud extends through the central aperture; and an adjustment knob aligned with the central aperture and coupled with the free end of the stud;

wherein a location of each of the at least one adjustment arm along the support bar is adjustable.

2. The shipping pallet wrapping system of claim 1, further comprising a guide base having a first side adjacent the support bar, a second side opposite the first side, and a stud aperture extending through the first side and the second side, wherein the stud extends through the stud aperture.

3. The shipping pallet wrapping system of claim 2, the second side of the guide base having a retention barrier with a raised lip surrounding the stud aperture, wherein the first end of the cylindrical body of the guide is nested within the retention barrier.

4. The shipping pallet wrapping system of claim 1, further comprising a sleeve surrounding the cylindrical body and configured to rotate freely about the cylindrical body.

5. The shipping pallet wrapping system of claim 1, the guide further having a support flange with a recess, the support flange extending radially outward from a second end of the cylindrical body distal to the support bar, wherein the adjustment knob is nested within the recess of the support flange.

6. The shipping pallet wrapping system of claim 1, wherein each of the at least two adjustment arms is configured to tighten onto the support bar when a corresponding adjustment knob is rotated in a first direction and to loosen in relation to the support bar when the corresponding adjustment knob is rotated in a second direction opposite the first direction.

7. The shipping pallet wrapping system of claim 1, further comprising a pre-stretch carriage on a second side of the support bar, the pre-stretch carriage supported by the base and configured to receive the stretch film from the at least two adjustment arms and stretch the stretch film in preparation for wrapping the palletized load.

8. The shipping pallet wrapping system of claim 1, further comprising at least one spool extending from the base and supporting at least one roll of the stretch film on a first side of the support bar, the at least one roll of stretch film configured to supply the stretch film to the at least two adjustment arms.

9. The shipping pallet wrapping system of claim 8, further comprising at least one blade positioned between the at least one roll of the stretch film and the at least two adjustment arms, wherein the at least one blade is configured to cut the stretch film as the stretch film moves from the at least one spool to the at least two adjustment arms.

10. A shipping pallet wrapping system, comprising:

a support bar extending from a base; and at least one adjustment arm coupled to the support bar and configured to narrow a width of a stretch film for wrapping a palletized load, each of the at least one adjustment arm comprising a fixed end moveably coupled to the support bar and a free end extending away from the support bar, the width of the stretch film engaging the at least one adjustment arm between the fixed end and the free end; and an adjustment knob coupled to each of the at least one adjustment arm at the free end of the at least one adjustment arm, the adjustment knob configured to releasably engage the at least one adjustment arm with the support bar;

wherein a location of each of the at least one adjustment arm along the support bar is adjustable.

11. The shipping pallet wrapping system of claim 10, further comprising a guide base having a first side adjacent the support bar, a second side opposite the first side, and an aperture extending through the first side and the second side, wherein the fixed end of the at least one adjustment arm extends through the aperture and the first side of the guide base includes a raised central ridge protruding toward the support bar.

12. The shipping pallet wrapping system of claim 11, the second side of the guide base having a retention barrier with a raised lip surrounding the aperture, wherein each of the at least one adjustment arm further comprises a first end of a cylindrical body of a guide nested within the retention barrier.

13. The shipping pallet wrapping system of claim 10, wherein each of the at least one adjustment arm is configured to tighten onto the support bar when a corresponding adjustment knob of the at least one adjustment arm is rotated in a first direction and to loosen and allow adjustment in relation to the support bar when the corresponding adjustment knob is rotated in a second direction opposite the first direction.

14. The shipping pallet wrapping system of claim 10, further comprising a pre-stretch carriage on a second side of the support bar, the pre-stretch carriage supported by the base and configured to receive the stretch film from the at least one adjustment arm and stretch the stretch film in preparation for wrapping the palletized load.

15. The shipping pallet wrapping system of claim 10, further comprising at least one spool extending from the base and supporting at least one roll of the stretch film on a first side of the support bar, the at least one roll of stretch film configured to supply the stretch film to the at least one adjustment arm.

16. A shipping pallet wrapping system, comprising:

a support bar extending from a base; and at least one adjustment arm coupled to the support bar and configured to narrow a width of a stretch film for wrapping a palletized load, each of the at least one adjustment arm comprising a fixed end moveably coupled to the support bar and a free end extending away from the support bar; and at least one adjustment knob coupled, respectively, to the free end of each of the at least one adjustment arm, the at least one adjustment knob, respectively, configured to releasably engage the at least one adjustment arm with the support bar and thereby enable a location adjustment of the at least one adjustment arm in relation to the support bar.

17. The shipping pallet wrapping system of claim 16, further comprising a guide base having a first side adjacent the support bar, a second side opposite the first side, and an aperture extending through the first side and the second side, wherein the fixed end of the at least one adjustment arm extends through the aperture and the second side of the guide base includes a retention barrier with a raised lip surrounding the aperture, wherein each of the at least one adjustment arm further comprises a first end of a cylindrical body of a guide nested within the retention barrier.

18. The shipping pallet wrapping system of claim 16, wherein each of the at least one adjustment arm is configured to tighten onto the support bar when the respective adjustment knob of the at least one adjustment arm is rotated in a first direction and to loosen and allow adjustment in relation to the support bar when the respective adjustment knob is rotated in a second direction opposite the first direction.

19. The shipping pallet wrapping system of claim 16, further comprising a pre-stretch carriage on a second side of the support bar, the pre-stretch carriage supported by the base and configured to receive the stretch film from the at least one adjustment arm and stretch the stretch film in preparation for wrapping the palletized load.

20. The shipping pallet wrapping system of claim 16, further comprising at least one spool extending from the base and supporting at least one roll of the stretch film on a first side of the support bar, the at least one roll of stretch film configured to supply the stretch film to the at least one adjustment arm.

* * * * *